United States Patent [19]

Nakamura et al.

[11] Patent Number: 4,668,179

[45] Date of Patent: May 26, 1987

[54] OIL BURNER OF THE WICK IGNITION TYPE

[75] Inventors: Kazuharu Nakamura; Yutaka Nakanishi, both of Aichi, Japan

[73] Assignee: Toyotomi Kogyo Co., Ltd., Aichi, Japan

[21] Appl. No.: 801,874

[22] Filed: Nov. 26, 1985

[30] Foreign Application Priority Data

Nov. 28, 1984 [JP] Japan ..... 59-251099

[51] Int. Cl.[4] ..... F23N 5/24; F23D 3/02

[52] U.S. Cl. ..... 431/121; 431/29; 431/300; 126/96

[58] Field of Search ..... 431/3, 29, 33, 121, 431/145, 300, 310, 312, 313, 320, 346; 126/96, 97

[56] References Cited

U.S. PATENT DOCUMENTS

| | | | |
|---|---|---|---|
| 10,355 | 7/1883 | Davis | 431/145 |
| 1,359,176 | 11/1920 | Kenworthy | 431/121 |
| 2,646,789 | 7/1953 | Lampert | 431/121 X |
| 4,465,457 | 8/1984 | Ishikawa et al. | 126/96 X |
| 4,480,987 | 11/1984 | Mandai et al. | 126/96 X |
| 4,515,557 | 5/1985 | Nishikawa et al. | 126/96 X |

FOREIGN PATENT DOCUMENTS

| | | | |
|---|---|---|---|
| 80633 | 7/1981 | Japan | 431/145 |

*Primary Examiner*—Margaret A. Focarino
*Attorney, Agent, or Firm*—Pollock, Vande Sande & Priddy

[57] ABSTRACT

An oil burner of the wick ignition type is disclosed which is capable of effectively preventing the generation of bad odor due to unburned fuel oil gas after the fire-extinguishing operation as well as during the operation. The oil burner includes an air pumping mechanism. The mechanism comprises an air pumping means which is adapted to discharge air to a combustion cylinder construction when it is heated and suck air thereinto from the combustion cylinder construction when it is cooled and an air chamber arranged between the pumping means and the combustion cylinder construction so as to be communicated with the both. The air pumping means may comprise a rigid closed vessel formed of a heat transfer material and arranged to receive heat directly from the combustion cylinder construction. Alternatively, it may comprise a deformable closed vessel and a vessel deforming member formed of a thermo-sensitive deformable material such as shape memory alloy and arranged to receive heat from the combustion cylinder construction.

14 Claims, 3 Drawing Figures

OIL BURNER OF THE WICK IGNITION TYPE

BACKGROUND OF THE INVENTION

1. Field of the Invention

This invention relates to an oil burner of the wick ignition type, and more particularly to such an oil burner which is adapted to feed fuel oil to a combustion cylinder construction due to the suction of fuel oil by means of a wick and carry out the fire-extinguishing by means of a fire-extinguishing device incorporated therein.

2. Descripton of the Prior Art

The fire-extinguishing of an oil burner of the wick ignition type in which fuel oil is sucked up to a combustion cylinder construction by means of a wick has been conventionally carried out in some ways. One is to stop the supply of fuel oil by means of a valve while keeping a wick stationary. Another way is to downwardly move a wick to receive a wick in a wick receiving chamber, to thereby stop the vaporization of fuel oil from the wick. A further way is to shield the upper portion of a wick at which the vaporization of fuel oil is carried out to interrupt the supply of air to the wick.

Unfortunately, the conventiojnal fire-extinguishing ways described above each are adapted to gradually decrease the vaporization of fuel oil during the fire-extinguishing operation, to thereby fail to momentarily accomplish the vaporization of fuel oil at the fire-extinguishing operation because a wick is used. For example, the wick lowering way requires about ten seconds for completing the fire-extinguishing. Also, the wick shielding way causes the vaporization of fuel oil to subsequently continue for relatively long period of time time although it momentarily blankets the flame of a wick. Accordingly, a conventional oil burner of the wick ignition type fails to prevent the generation of bad odor due to the vaporization of fuel oil after the fire-extinguishing operation as well as during the operation.

In view of the foregoing, an oil burner was proposed by Kazuharu Nakamura et al which is constructed to utilize such a wick shielding way as described and suck unburned fuel oil gas in a closed chamber by means of a spring means in association with the fire-extinguishing operation, to thereby prevent the discharge of the fuel oil gas to the exterior and decrease time required for the fire-extinguishing. Such an oil burner is disclosed in Japanese Patent Application No. 64905/1976, Japanese Patent Application Laid-Open Publication No. 2336/1973 and Japanese Patent Application Laid-Open Publication No. 66239/1973. However, the oil burner causes the generation of bad odor due to unburned fuel oil subsequently vaporized from a wick after the fire-extinguishing operation, because the suction of unburned fuel oil gas in the closed chamber is carried out in association with the fire-extinguishing operation.

Further, another oil burner was proposed which is constructed to suck unburned fuel oil gas by means of a suction pump driven by an ignition battery to substantially increase time for sucking the unburned gas, to thereby enhance the deodorization. However, such construction needs the replacement of the ignition battery every two or three months. Also, in the oil burner of such construction as well as the above-described conventional oil burner, the suction of unburned fuel oil gas during the fire-extinguishing operation carried out in an emergency such as earthquake has a close relationship to fire-extinguishing time, resulting in the fire-extinguishing time being substantially lengthened when the suction of the gas is incomplete. Further, in the oil burner of such construction, the discharge of air sucked together with unburned fuel oil gas to the exterior requires the removal of the unburned gas from the air. Otherwise, the discharge causes bad odor to be spread in a room.

Accordingly, it would be highly desirable to develop an oil burner which is capable of not only reducing fire-extinguishing time but preventing the generation of bad odor after the fire-extinguishing operation as well as during the operation.

SUMMARY OF THE INVENTION

Accordingly, it is an object of the present invention to provide an oil burner which is capable of effectively preventing the generation of bad odor due to unburned fuel oil gas after the fire-extinguishing operation as well as during the operation.

It is another object of the present invention to provide an oil burner which is capable of constantly ensuring the deodorization during and after the fire-extinguishing operation whenever the oil burner is operated.

It is a further object of the present invention to provide an oil burner which is capable of substantially decreasing fire-extinguishing time.

It is still another object of the present invention to provide an oil burner which is capable of further promoting the ignition and initiation of combustion.

It is yet another object of the present invention to provide an oil burner which is capable of effectively accomplishing the above-described objects with simple structure.

In accordance with the present invention, there is provided an oil burner which comprises a combustion cylinder construction; a wick receiving chamber communicated with the combustion cylinder construction; and an air pumping mechanism for discharging air to the combustion cylinder construction when it is heated and sucking air from the combustion cylinder construction when it is cooled, the air pumping mechanism being arranged to be communicated through the wick receiving chamber to the combustion cylinder construction.

In accordance with the present invention, there is also provided an oil burner comprising a combustion cylinder construction; a wick receiving chamber communicated with the combustion cylinder construction; and an air pumping mechanism for discharging air to the combustion cylinder construction when it is heated and sucking air thereinto from the combustion cylinder construction when it is cooled; the air pumping mechanism comprising a closed vessel formed of a rigid heat transfer material and arranged upwardly opposite to the combustion cylinder construction to receive heat therefrom and an air chamber arranged between the closed vessel and the wick receiving chamber so as to be communicated with the wick receiving chamber and closed vessel.

Also, in accordance with the present invention there is provided an comprising a combustion cylinder construction; a wick receiving chamber communicated with the combustion cylinder construction; and an air pumping mechanism for discharging air to the combustion cylinder construction when it is heated and sucking air thereinto from the combustion cylinder construction when it is cooled; the air pumping mechanism comprising a closed vessel formed of a rigid heat transfer material and arranged laterally opposite to the combustion cylinder construction to receive heat therefrom and an air chamber arranged between the closed vessel and the wick receiving chamber so as to be communicated with the wick receiving chamber and closed vessel.

Furthermore, in accordance with the present invention, there is provided an oil burner comprising a combustion cylinder construction; a wick receiving chamber communicated with the combustion cylinder construction; and an air pumping mechanism for discharging air to the combustion cylinder construction when it is heated and sucking air thereinto from the combustion cylinder construction when it is cooled; the air pumping mechanism comprising an air pumping means of the closed type and an air chamber arranged between the air pumpimg means and the wick receiving chamber so as to be communicated with the wick receiving chamber and air pumping means; the air pumping means of the closed type vessel comprising a deformable closed vessel member arranged at a position which does not cause it to be exposed to heat from the combustion cylinder construction and a vessel deforming member arranged at a position which allows it to receive heat from the combustion cylinder construction; the vessel deforming member being connected to the deformable closed vessel member to deform the latter when the former is subjected to a variation in temperature.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Now, an oil burner according to the present invention will be described hereinafter with reference to the accompanying drawings.

Figure 1:
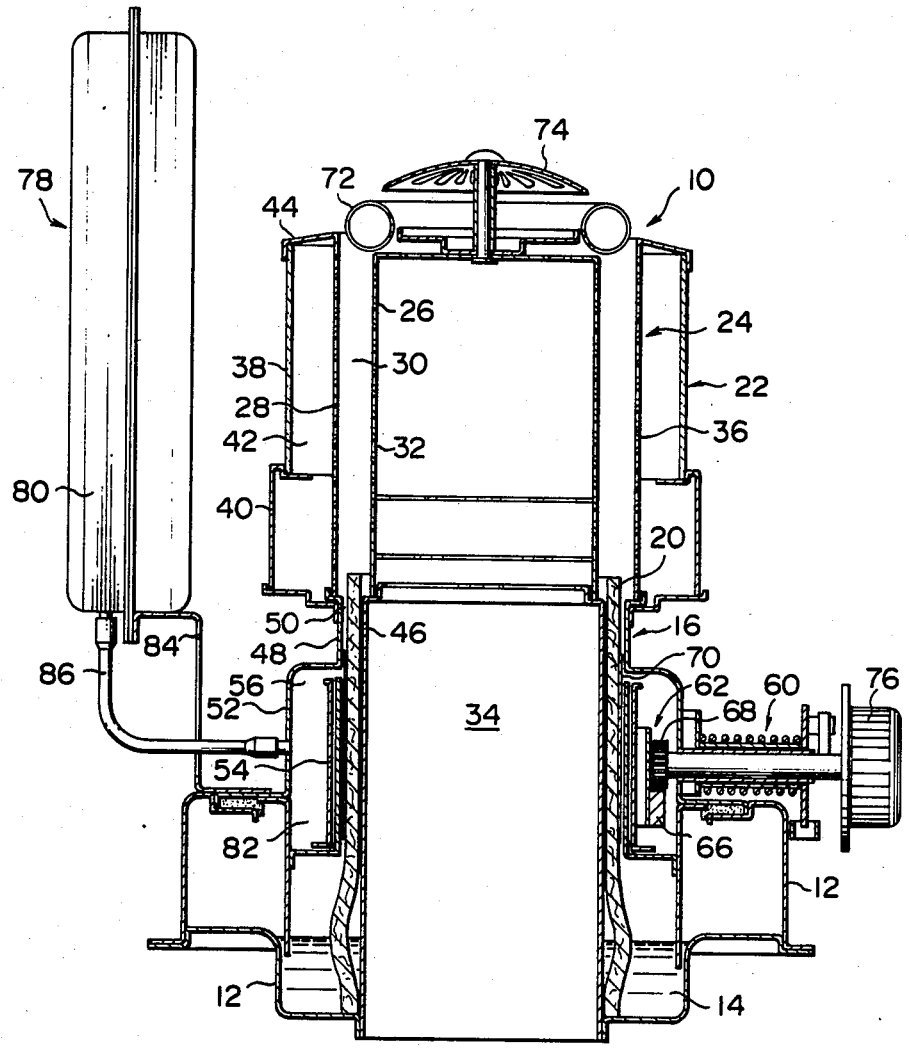
FIG. 1 is a vertical sectional view showing one embodiment of an oil burner according to the present invention.

FIG. 1 shows a first embodiment of an oil burner according to the present invention, wherein an oil burner of the illustrated embodiment is in the form of an oil-fired space heater of the wick ignition type and generally designated by reference numeral 10. However, the present invention is not limited to a space heater.

The oil burner 10 is constructed in a manner widely known in the art except an air pumping mechanism described below which is a feature of the present invention.

The oil burner 10 shown in FIG. 1 includes an oil reservoir 12 communicated with an oil tank (not shown) to store fuel oil 14 such as kerosine therein, a wick receiving cylinder 16 defining a wick receiving chamber which receives a wick 20 therein and is communicated with the oil reservoir 12, and a combustion cylinder construction 22 arranged on the wick receiving cylinder 16. The wick receiving cylinder 16 is oil-sealedly constructed in such a manner as known in the art so as to prevent the leakage of fuel oil therefrom to the outside.

The combustion cylinder construction 22 includes a double combustion cylinder 24 which comprises an inner cylindrical member 26 and an outer cylindrical member 28 which are arranged in a manner to be substantially concentric with each other with a space 30 of a suitable interval being defined therebetween. The inner cylindrical member 26 is formed with a plurality of through-holes 32 which serve to introduce a part of combustion air to the space 30 from an internal cylindrical space 34 formed in the oil burner 10 and communicated through the bottom of the burner with the exterior. Likewise, the outer cylindrical member 28 is formed with a plurality of through-holes 36. The combustion cylinder construction 22 also includes a heat-permeable cylinder 38 which is formed of a suitable heat resistant material such as heat resistant glass or the like and supported through a relatively rigid non-permeable cylinder 40 on the wick receiving cylinder 16. The heat-permeable cylinder 38 is arranged to surround the double combustion cylinder 24 with a space 42 of a suitable interval being defined therebetween and serves to outwardlY discharge therethrough heat rays emitted from the double combustion cylinder 24 head-heated due to combustion carried out in the space 30 and probably on the outside of the outer cylindrical member 28. The space 42 is closed at the upper end thereof by means of a top plate 44 of the outer cylindrical member 28.

The wick receiving cylinder 16 has an inner wall member 46 and an outer wall member 48 which are arranged to define therebetween an annular wick receiving chamber 50 communicated with the space 30 in the double combustion cylinder 24. When combustion is to be carried out, the wick 20, as shown in FIG. 1, is raised at the upper portion thereof from the wick receiving chamber 50 to the lower portion of the space 30 by means of a wick actuating mechanism described hereinafter. The outer wall member 48 of the wick receiving cylinder 16 is enlarged at a part of the lower portion thereof to form an outwardly expanded section 52, which cooperates with a wick moving plate 54 arranged on the outside of the wick 20 to form a fuel oil receiving chamber 56 therebetween which is communicated with the wick receiving chamber 50. The oil receiving chamber 56 serves to receive therein fuel oil absorbed in the wick and/or stored in the oil reservoir 12 to prevent the leakage of fuel oil to the exterior, when the oil burner 10 accidentally falls down. Also, the outer wall member 48 is enlarged at another part of the lower portion thereof to form another outwardly expanded portion for receiving therein a wick vertically moving mechanism described hereinafter.

The oil burner 10 also includes a fire-extinguishing device generally indicated by reference numeral 60, which is also constructed in a manner as widely known in the art. In the illustrated embodiment, the fire-extinguishing device 60 comprises a wick vertically moving mechanism 62 and a wick shielding mechanism (not shown). The wick vertically moving mechanism 62 may include a rack 66, a pinion 68 and a wick moving plate 70 movably arranged between the wick 20 and the partition plate 54 and having a part of the wick fixedly held thereon. In the illustrated embodiment, as described above, the wick moving mechanism 62 is substantially received in the lower portion of the wick receiving cylinder 16. The wick shielding mechanism may comprise a shield plate which is adapted to project into a space between the wick 20 and the combustion cylinder construction 22, as in another embodiment of the present invention described hereinafter.

Reference numeral 72 designates a coil formed of metal, which is red-heated due to combustion heat generated from the space 30 during the combustion operation, and reference numeral 74 designates a top plate arranged above the internal space 34. Further, 76 indicates a knob for driving the fire-extinguishing device 60.

The featured construction of the oil burner of the present invention is in that it has an air pumping mechanism incorporated therein. Generally speaking, the air pumping mechanism comprises an air pumping means of the closed type for storing air therein and an air chamber interposedly arranged between the air pumping means and the wick receiving chamber in a manner to be communicated with the both. The air pumping means is adapted to pump air through the air chamber with respect to the combustion cylinder construction depending upon a variation in temperature and may be arranged at any desired position with respect to the oil burner. The air chamber may use any space defined in the oil burner so long as it may receive air therein and be communicated with the wick receiving chamber.

In the oil burner of the embodiment shown in FIG. 1, the air pumping mechanism includes an air actuating means 78 comprising a rigid closed vessel 80 of a relatively flat rectangular shape arranged to receive heat rays outwardly discharged from the red-heated double combustion cylinder 24 through the heat-permeable cylinder 38 so that it may be heated by the heat rays, and an air chamber 82. In the illustrated embodiment, the oil receiving chamber 56 is used as the air chamber 82, and the closed vessel 80 is formed of metal and supported on the oil reservoir 12 through a stand 84 mounted on the oil reservoir 12 in a manner to be opposite to the double combustion cylinder 24 so that it may directly heat from the combustion cylinder construction 22. The closed vessel 80 and air chamber 82 are communicated with each other through a connecting pipe 86. .

Now, the manner of operation of the oil burner of the illustrated embodiment constructed as described above will be described hereinafter with reference to FIG. 1.

First, the wick 20 is raised at the upper end thereof to the lower portion of the space 30 between the inner and outer cylindrical members 26 and 28 through the knob 76 and wick vertically moving mechanism 62 and then ignited to initiate combustion. During the combustion operation, the adjustment of combustion may be carried out by means of the knob 76 and mechanism 62.

In the illustrated embodiment, the closed vessel 80 constituting the air pumping means 78 in which air is received is arranged at position of allowing it to receive heat directly from the double combustion cylinder 24 or opposite thereto. Thus, the closed vessel 80 is heated upon initiation of the combustion operation to cause air received therein to be gradually discharged therefrom through the connecting pipe 86 toward the air chamber 82, so that the air may be discharged through the wick receiving chamber 50 to the double combustion cylinder 24 and used as a part of combustion air to more effectively promote the regular combustion. This results in air received in the closed vessel 80 being substantially decreased when the combustion reaches a stable regular state.

Then, when the oil burner 10 is extinguished, the transmission of heat from the double combustion cylinder 24 to the closed vessel 80 is interrupted to cause the vessel 80 to be rapidly cooled, so that it may be placed in a state capable of receiving a large volume of air therein. This results in the closed vessel 80 sucking thereinto air through the air chamber 82 from the combustion cylinder construction 22. It has been found that the capability that the closed vessel 80 sucks air thereinto is maximum immediately after the fire-extinguishing, and the suction continues for one minute or more although it somewhat depends upon a position at which the closed vessel 80 is arranged. This causes unburned fuel oil vapor or gas of bad odor drifting around the wick 20 immediately after the fire-extinguishing operation to be carried to the closed vessel 80 on air sucked thereinto, to thereby substantially prevent the unburned gas from being outwardly discharged. Also, the gas sucked into the closed vessel 80 is prevented from leaking after the fire-extinguishing, because the vessel 80 is substantially closedly constructed.

On the assumption that the closed vessel 80 has a volume of 2000 $cm^3$; when a temperature of air received in the vessel is increased by 270° C., the air is increased to 4000 $cm^3$ in volume. This causes air of about 2000 $cm^3$ to be discharged from the closed vessel 80 through the air chamber 82 to the combustion cylinder construction 22. This indicates that the total amount of air sucked into the vessel after the fire-extinguishing mounts to about 2000 $cm^3$. Also, it has been found that air of 600 $cm^3$ is sucked in one minute after the fire-extinguishing.

Air sucked into the closed vessel 80 after the fire-extinguishing contains a large volume of unburned fuel gas, accordingly, the condensation of the gas in the closed vessel causes additional air to be sucked thereinto corresponding to the reduction of volume of the gas, so that the generation of bad odor after the fire-extinguishing may be more effectively prevented. The so-condensed unburned fuel oil gas can be outwardly discharged when the closed vessel 80 is positioned above the air chamber 82. However, this is not necessarily required in the illustrated embodiment; because the oil burner of the embodiment is adapted to initiate the heating of the closed vessel 80 after the ignition operation, so that the condensed fuel oil may be vaporized with the advance of the combustion and discharged together with air from the vessel 80 through the connecting pipe 86 and air chamber 82 to the double combustion cylinder 24, to thereby be burned therein.

In the embodiment shown in FIG. 1, the air chamber is formed by the oil receiving chamber 56. However, the present invention is not limited to such construction. When it is impossible to provide such an oil receiving chamber in an oil burner or it is not desirable to use such an oil receiving chamber as the air chamber; any internal space defined at the upper portion of the oil reservoir 12 such as, for example, the space receiving the wick vertically moving mechanism 62 therein, a part of the wick receiving chamber 50, or the like may be used as the air chamber 82. Also, the present invention is not limited to such arrangement of the air pumping means 78 in an upright state as shown in FIG. 1.

Figure 2:
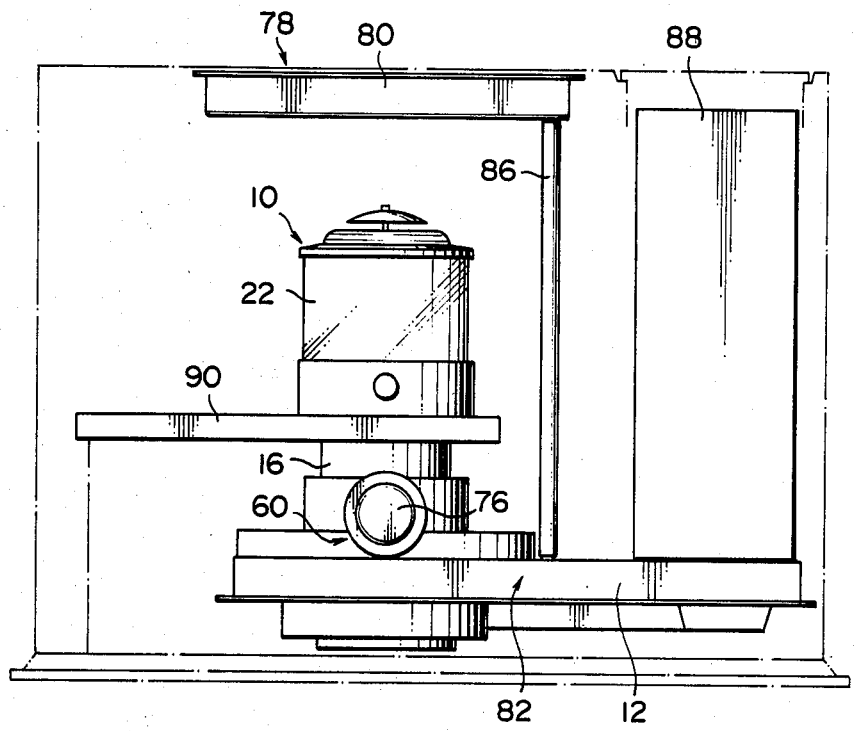
FIG. 2 is a schematic front elevation view showing another embodiment of an oil burner according to the present invention.

FIG. 2 shows another embodiment of an oil burner according to the present invention. An oil burner 10 of the illustrated embodiment is constructed in a manner such that a closed vessel 80 constituting an air pumping means of the closed type is arranged above the oil burner 10 by means of a supporting member (not shown) so as to be opposite to a double combustion cylinder 24 and an internal upper space of an oil reservoir 12 is used as an air chamber 82. In the embodiment, it is of course that the upper space of the oil reservoir 12 is communicated with a wick receiving chamber (not shown). The formation of such communication between both parts is obvious to those skilled in the art. The closed vessel 80 is communicated with a vertical connecting pipe 86 with the air chamber 82. Reference numeral 88 designates a cartridge-type oil tank disposed on the oil reservoir 12 so as to be communicated therewith and reference numeral 90 designates a shield plate which is adapted to be actuated in an emergency such as earthquake in a manner to project between a wick receiving cylinder 16 and a combustion cylinder construction 22 to interrupt the communication therebetween, so that the fire-extinguishing in an emergency may be carried out. The cartridge-type oil tank 88 and shield plate 90 each may be constructed in such a manner as known in the art. The remaining part of the illustrated embodiment may be constructed in substantially the same manner as that shown in FIG. 1.

It will be readily noted that the oil burner shown in FIG. 2 exhibits the same advantages as that shown in FIG. 1.

In each of the embodiments shown in FIGS. 1 and 2, as described above, the air pumping means 78 comprising the rigid closed vessel 80 is arranged to directly receive heat from the combustion cylinder construction 22. However, the present invention is not limited to such structure.

Figure 3:
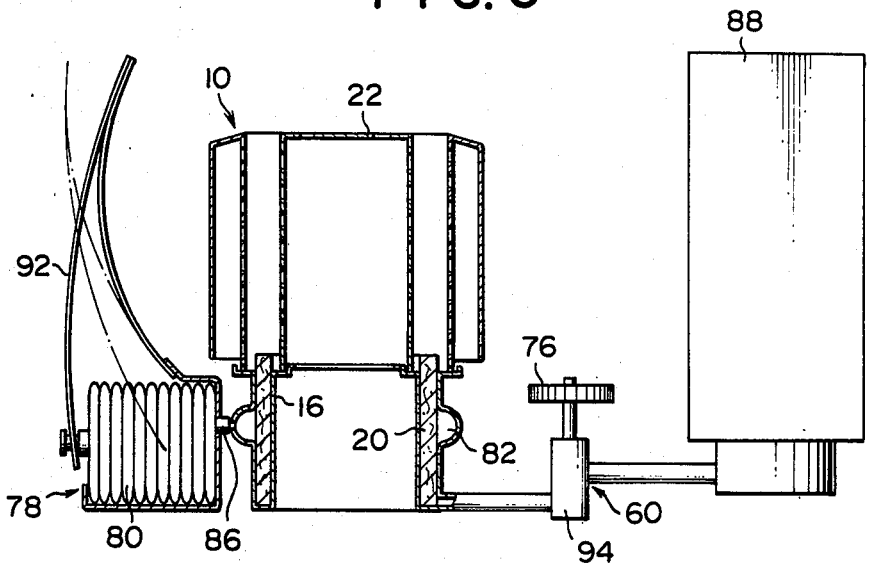
FIG. 3 is front elevation view partly in section showing a further embodiment of an oil burner according to the present invention.

FIG. 3 shows a further embodiment of an oil burner according to the present invention. An air pumping mechanism in an oil burner 10 of the embodiment shown in FIG. 3 includes air actuating means of the closed type 78 which comprises a flexible closed vessel 80 formed of a deformable material such as flexible or soft rubber or plastic, or the like and arranged away from a combustion cylinder construction so as not to receive heat directly therefrom and a vessel deforming member 92 formed of a thermo-sensitive deformable material such as bimetal, shape memory alloy or the like and arranged to receive heat from the combustion cylinder construction 22 to deform depending upon a variation in temperature to vary the volume of the closed vessel 80 in a manner such that it is decreased when the member 92 is heated and increased when it is cooled. In the illustrated embodiment, the closed vessel 80 comprises a contractible bellows member and the vessel deforming member 92 is formed of two shape memory alloy sheets into a substantially pine-needle shape and connected at the open end thereof to both sides of the closed vessel 80 to deform the vessel depending upon the temperature of the member 92 to vary the volume of the closed vessel 80 in the above-described manner.

The air pumping mechanism 78 in the embodiment illustrated in FIG. 3 also includes an air chamber 82 which is formed by circumferentially outwardly expanding a part of an outer wall 48 of a wick receiving cylinder 16 forming a wick receiving chamber and connected to the closed vessel 80 through a connecting pipe 86.

In the oil burner shown in FIG. 3, an oil reservoir such as the reservoir 12 shown in FIG. 1 or 2 is not provided. Instead, a fuel oil interruption mechanism 94 is provided between the wick receiving cylinder and a cartridge-type oil tank 88 to interrupt an oil passage therebetween when the fire-extinguishing is desired. The mechanism 94 may be constructed in a manner known in the art In the illustrated embodiment, it may comprise a shut-off valve. The remaining part of the oil burner shown in FIG. 3 may be constructed in substantially the same manner as those shown in FIGS. 1 and 2.

In the oil burner shown in FIG. 3, when it is ignited to initiate the combustion, the vessel deforming member 92 in a state indicated by solid lines in FIG. 3 is heated to deform the closed vessel 80 to decrease the volume of the vessel as indicated by phantom lines in FIG. 3, so that air received in the vessel may be discharged from the vessel through the connecting pipe and air chamber 82 to the combustion cylinder construction. Then, when the fire-extinguishing is carried out, the vessel deforming member 92 is cooled to return from the state indicated by the phantom lines to that of the solid lines to increase the volume of the vessel 80, so that air may be sucked from the combustion cylinder construction 22 through the air chamber 82 and connecting pipe 86 into the closed vessel 80. Thus, it will be noted that the embodiment illustrated exhibits substantially the same advantages as those shown in FIGS. 1 and 2.

As can be seen from the foregoing, the oil burner of the present invention has the air pumping mechanism incorporated therein which includes the closed vessel and the air chamber interposedly arranged between the closed vessel and the combustion cylinder construction so as to be communicated with the both. Such construction of the present invention effectively prevents unburned fuel oil gas from being discharged to the exterior during and after the fire-extinguishing operation, to thereby eliminate the diffusion of bad odor to the exterior. Also, such construction for preventing bad odor in the present invention does not utilize any external energy such as a motor driven by a battery, so that it may constantly be actuated whenever the oil burner is used or operated.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An oil burner of the wick ignition type comprising:

a combustion cylinder construction a wick receiving chamber communicated with said combustion cylinder construction; and an air pumping mechanism of the closed type for storing air therein and having heat receiving means for causing air to be discharged to said combustion cylinder construction when said means is heated and to be sucked from said combustion cylinder construction when said means is cooled, said air pumping mechanism being communicated through said wick receiving chamber with said combustion cylinder construction, and said heat receiving means being arranged at a position which allows it to receive heat from said combustion cylinder construction.

2. An oil burner as defined in claim 1, wherein said air pumping mechanism comprises a closed vessel and an air chamber arranged between said closed vessel and said wick receiving chamber so as to be communicated with said wick receiving chamber and said closed vessel.

3. An oil burner as defined in claim 2, wherein said heat receiving means comprises said closed vessel, said closed vessel being formed of a rigid heat transfer material and aranged at a position which allows said closed vessel to directly receive heat from said combustion cylinder construction.

4. An oil burner as defined in claim 3, wherein said closed vessel is arranged laterally opposite to said combustion cylinder construction.

5. An oil burner as defined in claim 3, wherein said closed vessel is positioned above said combustion cylinder construction so as to receive heat directly from said combustion cylinder construction.

6. An oil burner as defined in claim 2, wherein said closed vessel comprises a deformable vessel member provided at a position which does not cause said vessel member to be exposed to heat from said combustion cylinder construction, and said heat receiving means comprises a vessel deforming member connected to said deformable vessel member to deform it when said vessel deforming member is subjected to a variation in temperature.

7. An oil burner as defined in claim 6, wherein said vessel deforming member is formed of a thermo-sensitive deformable material and connected to said deformable vessel member in a manner to interpose both sides thereof.

8. An oil burner as defined in claim 2, wherein said air chamber is defined in an oil reservoir provided at the lower portion of said oil burner so as to be communicated with said wick receiving chamber.

9. An oil burner as defined in claim 2, wherein said air chamber is defined in a wick moving mechanism receiving chamber which is formed at a lower portion of a wick receiving cylinder defining said wick receiving chamber therein so as to be communicated with said wick receiving chamber.

10. An oil burner as defined in claim 2, wherein said air chamber is defined in an oil receiving chamber which is formed at a lower portion of a wick receiving cylinder defining said wick receiving chamber therein so as to be communicated with said wick receiving chamber.

11. An oil burner as defined in claim 2, wherein said air chamber is defined in said wick receiving chamber.

12. An oil burner of the wick ignition type comprising a combustion cylinder construction;

a wick receiving chamber communicated with said combustion cylinder construction; and an air pumping mechanism for discharging air to said combustion cylinder construction when it is heated and sucking air thereinto from said combustion cylinder construction when it is cooled;

said air pumping mechanism comprising a closed vessel formed of a rigid heat transfer material and arranged upwardly opposite to said combustion cylinder construction to receive heat therefrom and an air chamber arranged between said closed vessel and said wick receiving chamber so as to be communicated with said wick receiving chamber and closed vessel.

13. An oil burner of the wick ignition type comprising:

a combustion cylinder construction;

a wick receiving chamber communicated with said combustion cylinder construction; and an air pumping mechanism for discharging air to said combustion cylinder construction when it is heated and sucking air thereinto from said combustion cylinder construction when it is cooled;

said air pumping mechanism comprising a closed vessel formed of a rigid heat transfer material and arranged laterally opposite to said combustion cylinder construction to receive heat therefrom and an air chamber arranged between said closed vessel and said wick receiving chamber so as to be communicated with said wick receiving chamber and closed vessel.

14. An oil burner of the wick ignition type comprising:

a combustion cylinder construction;

a wick receiving chamber communicated with said combustion cylinder construction; and an air pumping mechanism for discharging air to said combustion cylinder construction when it is heated and sucking air thereinto from said combustion cylinder construction when it is cooled;

said air pumping mechanism comprising an air pumping means of the closed type and an air chamber arranged between said air pumping means and said wick receiving chamber so as to be communicated with said wick receiving chamber and air pumping means;

said air pumping means of the closed type comprising a deformable closed vessel member arranged at a position which does not cause it to be exposed to heat from said combustion cylinder construction and a vessel deforming member arranged at a position which allows it to receive heat from said combustion cylinder construction;

said vessel deforming member being connected to said deformable closed vessel member to deform the latter when the former is subjected to a variation in temperature.

* * * * *